US010443188B2

(12) United States Patent
De Jonge et al.

(10) Patent No.: US 10,443,188 B2
(45) Date of Patent: Oct. 15, 2019

(54) PROCESS FOR CUT PILE CARPET TILES WITH SEAMLESS APPEARANCE

(71) Applicant: Apache Mills, Inc., Calhoun, GA (US)

(72) Inventors: Duane De Jonge, Dalton, GA (US); Tanner De Jonge, Dalton, GA (US)

(73) Assignee: Apache Mills, Inc., Calhoun, GA (US)

( * ) Notice: Subject to any disclaimer, the term of this patent is extended or adjusted under 35 U.S.C. 154(b) by 0 days.

(21) Appl. No.: 15/604,143

(22) Filed: May 24, 2017

(65) Prior Publication Data

US 2017/0342653 A1 Nov. 30, 2017

Related U.S. Application Data

(60) Provisional application No. 62/341,441, filed on May 25, 2016.

(51) Int. Cl.
*D06H 7/00* (2006.01)

(52) U.S. Cl.
CPC ..... *D06H 7/00* (2013.01); *D10B 2503/04* (2013.01)

(58) Field of Classification Search
CPC ..... D06H 7/00; D10B 2503/04
See application file for complete search history.

(56) References Cited

U.S. PATENT DOCUMENTS 1,476,479 A 12/1923 Allen
2,931,401 A 4/1960 Lambert
3,296,911 A 1/1967 McLane
3,407,690 A 10/1968 Stanley
3,537,662 A * 11/1970 Keesling ..... B65H 16/08 242/527.5
3,621,743 A 11/1971 Feighery et al.
3,641,854 A * 2/1972 Keesling ..... D06H 7/02 83/175
3,742,799 A 7/1973 Olday
3,768,101 A 10/1973 Kuts
3,768,347 A * 10/1973 Wade ..... B26D 3/10 33/27.12
3,815,458 A 6/1974 Jirousek
3,818,790 A * 6/1974 Culp ..... D06H 7/00 83/408
4,022,087 A 5/1977 Queen et al.
(Continued)

FOREIGN PATENT DOCUMENTS

AU 684109 B2 4/1997
EP 0391552 A1 3/1990
(Continued)

OTHER PUBLICATIONS

ISA/KR, International Search Report and Written Opinion—PCT/US2017/034397, dated Aug. 30, 2017, Daejeon, Republic of Korea.

*Primary Examiner* — Jonathan G Riley
(74) *Attorney, Agent, or Firm* — Thomas B. McGurk

(57) ABSTRACT

Processes for cutting carpet tiles that when abutted, have a seamless appearance. The processes cut an extended length of carpet into individual tiles through the backing of the carpet, thus not disturbing the pile of the carpet, resulting in reduced visibility of the seam between abutting carpet tiles. The processes include cutting the carpet crosswise, through the backing, to form strips, and then cutting the strips, through the backing, to form tiles.

2 Claims, 9 Drawing Sheets

(56) References Cited

U.S. PATENT DOCUMENTS 4,041,818 A * 8/1977 Rummer ..... B26D 7/0675 83/256
4,043,231 A 8/1977 Friedberg
4,059,465 A 11/1977 Edgar et al.
4,133,234 A * 1/1979 Gerber ..... B26D 5/00 83/56
4,207,787 A 6/1980 Lewallyn
4,244,102 A * 1/1981 Bolles ..... D06H 7/00 144/136.1
4,381,686 A 5/1983 Ess
4,517,872 A 5/1985 Dontscheff
4,528,882 A * 7/1985 Axford ..... B26F 1/40 83/266
4,655,784 A 4/1987 Rahman
4,662,069 A * 5/1987 Pate ..... B26B 25/00 30/273
4,785,750 A 11/1988 Best
4,793,033 A * 12/1988 Schneider ..... D06C 23/02 26/16
4,928,391 A 5/1990 Higgins et al.
5,289,749 A 3/1994 Imai et al.
5,324,562 A 6/1994 Mullinax et al.
5,832,802 A * 11/1998 Warthen ..... B26D 1/09 83/555
5,979,278 A 11/1999 Warthen et al.
6,197,400 B1 3/2001 Desai
6,203,879 B1 3/2001 Desai
6,397,544 B1 6/2002 Desai
6,609,348 B2 8/2003 Desai
6,849,317 B1 2/2005 Oakey et al.
7,350,443 B2 * 4/2008 Oakey ..... A47G 27/0275 428/48
7,993,717 B2 8/2011 O'Connor
2002/0043145 A1 4/2002 Ricci
2006/0154014 A1 * 7/2006 Parkey ..... G09F 19/22 428/43
2009/0031870 A1 2/2009 O'Connor
2009/0032180 A1 * 2/2009 O'Connor ..... B23K 26/0846 156/249
2012/0073417 A1 * 3/2012 Ujiie ..... B26D 7/018 83/24
2012/0085208 A1 * 4/2012 Supernavage ..... B26B 29/06 83/13
2015/0337470 A1 * 11/2015 Evans, Jr. ..... D05C 17/02 428/54

FOREIGN PATENT DOCUMENTS

EP 0456864 A1 11/1991
EP 0725711 B1 8/1996
EP 0725711 A4 2/1997
GB 1338030 11/1973
JP 03-021765 A 1/1991
JP 10 118988 A 5/1998
WO WO 9119144 A1 11/1991
WO WO 9506548 A1 3/1995

* cited by examiner

PROCESS FOR CUT PILE CARPET TILES WITH SEAMLESS APPEARANCE

CROSS-REFERENCE

This application claims priority to U.S. provisional application 62/341,441 filed May 25, 2016, the entire disclosure of which is incorporated herein by reference.

BACKGROUND

The present disclosure relates to methods, processes and systems for carpet manufacturing, particularly, carpet tile manufacturing.

Traditionally, the carpet industry has been cutting carpet into carpet tiles (e.g., 18 inch square, 24 inch square) using a die press method using a hydraulic press to exert a force on a metal die, forcing the die through the carpet face and substrate (backing) of the carpet. It has been found that carpet tiles that have been cut in this manner are very difficult to lay without the abutting joint of adjacent tiles being seen to the naked eye by a casual observer.

SUMMARY

This disclosure provides methods and systems for cutting a carpet tile from a carpet roll, whereby the resulting carpet tiles, when laid side by side, have a substantially seamless appearance. The methods produce cut tiles that need no additional processing to substantially reduce the tendency of the seam line to be visible.

One particular implementation disclosed herein is a method for forming carpet tiles that have a seamless appearance when abutted. The method includes providing a carpet having a width and a length, the carpet having a backing with pile extending therefrom, cutting the carpet through the backing and not cutting the pile to form at least one carpet strip, and cutting the at least one carpet strip through the backing and not cutting the pile to form at least one carpet tile.

Another particular implementation disclosed herein is a method for forming carpet tiles by providing a length of carpet having a width, the carpet having a backing with pile extending therefrom, cutting the length of carpet through the backing across its width and not through the pile to form at least one carpet strip, and cutting the at least one carpet strip through the backing and not through the pile to form at least one carpet tile. In an alternate implementation, the method includes, rather, cutting the length of carpet through the backing along its length and not through the pile to form at least one carpet strip.

Another particular implementation disclosed herein is a method for forming carpet tiles by providing an extended length of carpet having a backing and pile, cutting the carpet crosswise with at least two blades each moving along a crosswise track through the backing across its width, and cutting the carpet lengthwise with at least two blades each moving along a lengthwise track through the backing.

Yet another particular implementation disclosed herein is a method for forming carpet tiles by supporting a carpet having a backing and pile on at least one pedestal, with the backing in contact with the pedestal(s), cutting the carpet crosswise across its width with at least two blades each moving along a crosswise track below the carpet, and cutting the carpet lengthwise with at least two blades each moving along a lengthwise track below the carpet.

In any or all of these methods, a blade cutting the carpet passes through the backing without cutting the pile extending above the backing. In some implementations, the blade may extend, e.g., no more than ⅛ into the pile, but does not disturb (e.g., cut) the pile.

The methods of this disclosure provide tiles, that when joined in abutting relationship, have a seamless appearance. In one particular implementation, disclosed herein is an array of at least two carpet tiles, each of the tiles having a backing and pile extending therefrom, each tile having at least one cut edge; in some implementations, all edges (e.g., 4 edges) will be cut edges. When the cut edges of the carpet tiles are abutted, a seamless appearance is obtained.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. These and various other features and advantages will be apparent from a reading of the following detailed description.

BRIEF DESCRIPTION OF THE DRAWING

The described technology is best understood from the following Detailed Description describing various implementations read in connection with the accompanying drawing.

DESCRIPTION

Figure 1:
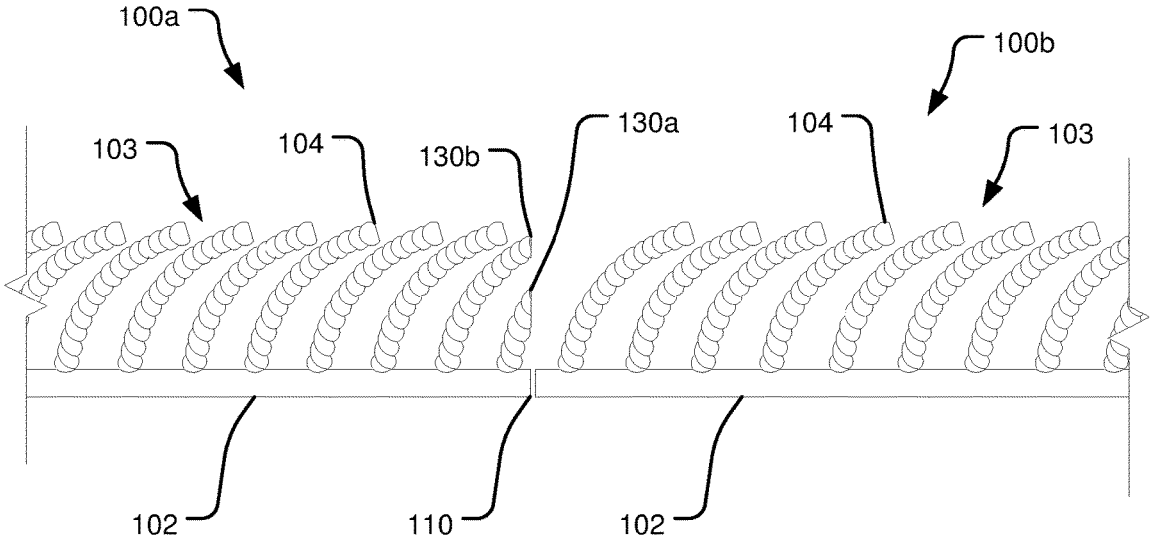
FIG. 1 is a schematic side view of two carpet tiles having a readily visible seam.

The present disclosure provides methods for cutting a carpet tile, such as a cut pile carpet tile, whereby the resulting carpet tiles, when laid side by side, substantially reduce the tendency of the seam line to be visible. The methods of this disclosure produce carpet tiles that, when installed, alleviate the seaming effect observed after the tiles have been installed. The methods, processes and systems of this disclosure are particularly well suited for cut pile carpets (e.g., cut pile plush, cut pile twist, frieze, tufted, etc.) and combination cut and loop pile (e.g., level cut and loop pile, textured cut and loop pile, etc.).

The following description provides specific implementations. It is to be understood that other implementations are contemplated and may be made without departing from the scope or spirit of the present disclosure. The following detailed description, therefore, is not to be taken in a limiting sense. While the present disclosure is not so limited, an appreciation of various aspects of the disclosure will be gained through a discussion of the examples provided below.

In the following description, reference is made to the accompanying drawing that forms a part hereof and in which are shown by way of illustration at least one specific implementation. In the drawing, like reference numerals may be used throughout several figures to refer to similar components. In some instances, a reference numeral may have an associated sub-label consisting of a lower-case letter to denote one of multiple similar components. When reference is made to a reference numeral without specification of a sub-label, the reference is intended to refer to all such multiple similar components.

Turing to FIG. 1, two carpet tiles 100*a*, 100*b* are illustrated laid in abutment next to each other. Each carpet tile 100 has a backing or substrate 102 and an opposite carpet face 103 having carpet pile 104. The term "pile," as used herein, can be used to represent either one strand or multiple strands, and not using "pile" in the plural sense should not be construed as limiting in any way. The carpet pile 104 is directional; that is, the pile 104 lays over in a direction, which is due to the movement of the carpet through the tufting machine (prior to being cut into tiles).

The two carpet tiles 100*a*, 100*b* are abutted at a seam 110. As seen in FIG. 1, proximate the location of the seam 110, the pile 104 is not continuous; rather, the pile 104 of each of the tiles 100 has been disturbed, e.g., cut, partially cut, crushed, or otherwise damaged. In FIG. 1, the tile 100*a* has two disturbed piles 130*a*, 130*b*, both which have been cut, forming piles that are shorter than the others.

These disturbed piles 130 are due to the original directional pile 104 having been cut with a die press method. The die press method exerts a force perpendicular to the backing 102 and the pile 104 of the carpet. The carpet piles 104 that extend over the cutting region are cut by the die, resulting in a cut short pile. In this example of FIG. 1, two rows of piles 104 on the tile 100*a* result in the disturbed piles 130*a*, 130*b* after being cut. As the disturbed piles 130 have been distorted by the die method process, they no longer lay over the edge of the tile 100 in the same manner undistorted piles lays, thus causing the seam 110 to be readily visible.

Figure 2:
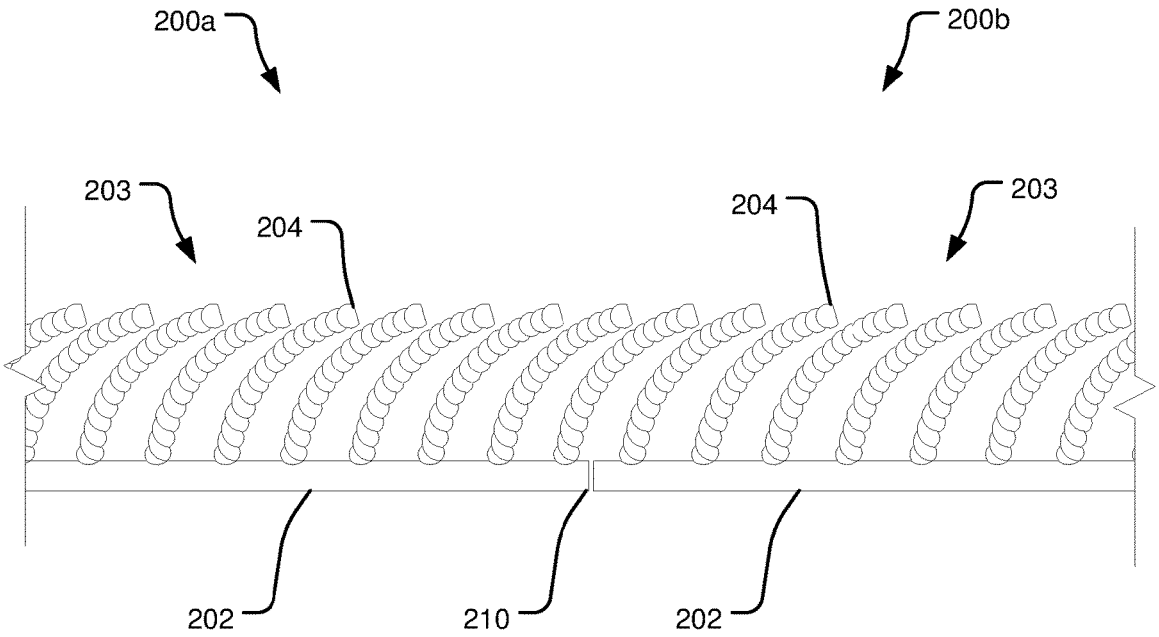
FIG. 2 is a schematic side view of two carpet tiles made by a method of this disclosure.

Two tiles 200, formed by a process of this disclosure, are shown in FIG. 2 as tile 200*a* and tile 200*b* laid in abutment to each other. Similar to the tiles 100 of FIG. 1, each carpet tile 200 has a backing or substrate 202 and an opposite carpet face 203 having carpet pile 204. The tiles 200 meet at a seam 210.

In FIG. 2, it is readily seen that the pile 204 of neither tile 200 is disturbed, but that undisturbed piles 204 of both tiles 200 lay over the abutment seam 210. The natural pile direction of the carpet face 203 and the undisturbed piles 204 represent the same pile lay over across the seam 210, creating a consistent flow between tiles 200*a*, 200*b*. The resulting seam 210 tends to be far less visible by the naked eye to a casual observer than the seam 110 of FIG. 1.

Figure 3:
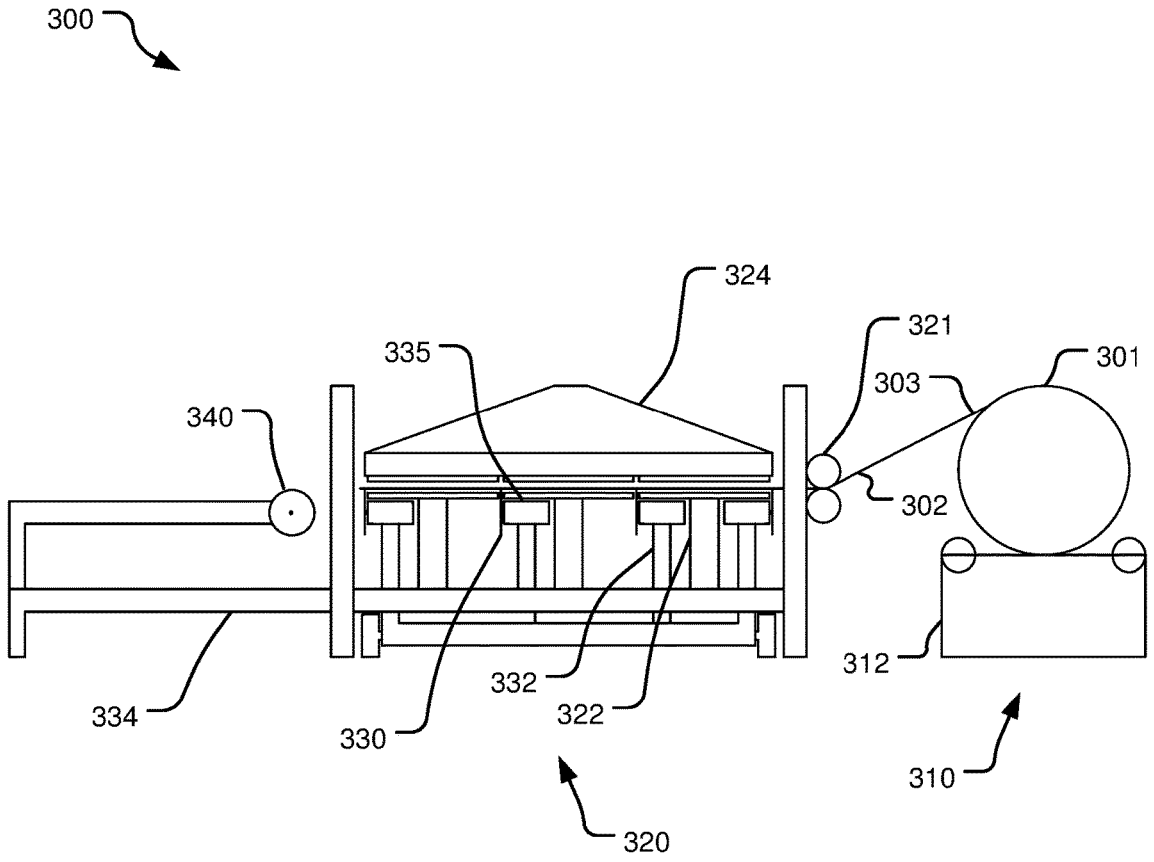
FIG. 3 is a schematic side view of an example cutting system.
Figure 4:
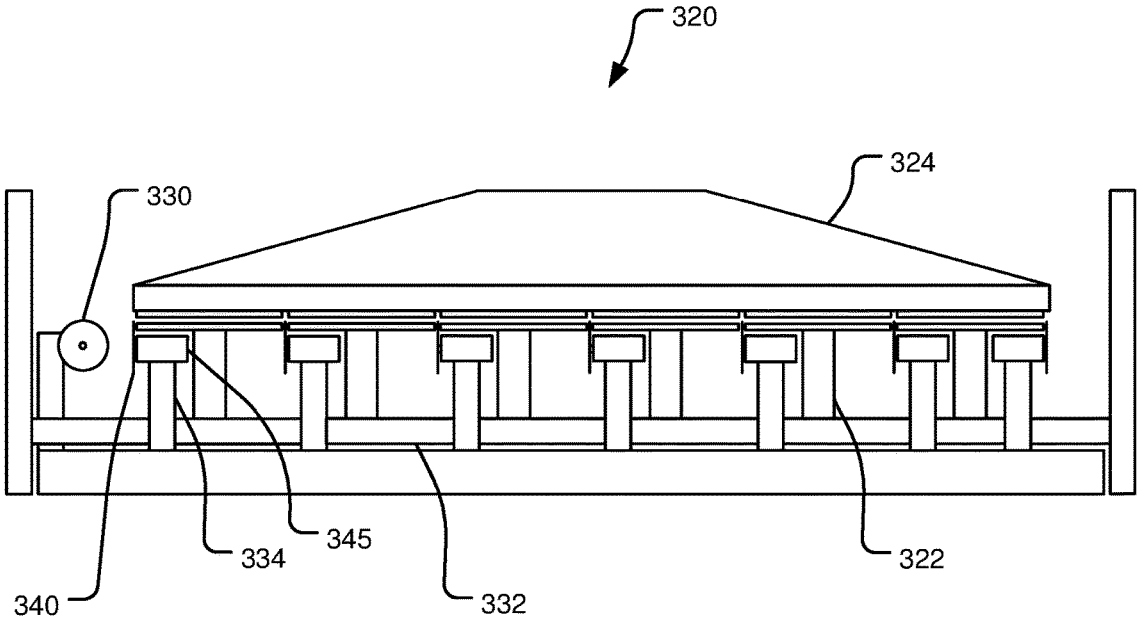
FIG. 4 is a schematic front view of the cutting system of FIG. 3.

The tiles 200 are made by the methods and processes described below. In general, the methods and processes include cutting rolled carpet crosswise (across its width) and lengthwise through the substrate or backing of the carpet. The rolled carpet is commonly broadloom carpet, having a width, e.g., of 12 feet and any elongate length. FIGS. 3 and 4 illustrate schematically an example cutting system 300.

Turning to FIG. 3, the cutting system 300 is shown with a carpet feed station 310 having a carpet roll support 312. A roll of carpet 301 is shown in the feed station 310, the carpet having a backing or substrate 302 and a carpet face 303. In this particular illustration, the carpet 301 is rolled with the backing 302 on the inside, with the carpet face 303 (having the pile) on the outside of the roll; in other implementations, the carpet 301 may be rolled the other way, with the backing 302 on the outside and the carpet face 303 on the inside. In other implementations, the carpet 301 may not rolled, but retained in some other manner that an extended length of carpet may be retained.

The system 300 also has a carpet cutting station 320 that includes a roll feed mechanism 321 configured to receive carpet 301 from the feed station 310, a plurality of pedestals 322, a retainer 324 (e.g., a vacuum press), a first array of crosscut blades 330 and a second array of lengthwise blades 340. The pedestals 322 have a carpet supporting surface and are arranged as an array extending crosswise and lengthwise in relation to unrolled carpet 301. Each array of blades 330, 340 includes at least two blades, depending on any or all of the size of the carpet 301 to be cut, the size of the cut tiles, and the number of and arrangement of the pedestals 322. The type, size and style of blades 330, 340 are selected based on the type and thickness of the backing 302 (e.g., polypropylene, polyurethane, felt, PVC, recycled glass, etc.), the desired depth of cut, and the desired speed of cutting. Each blade 330, 340 in the arrays of blades 330, 340 is moveable; the crosscut blades 330 are moveable in the crosscut direction of the carpet 301 along a drive track 332 and the lengthwise blades 340 are moveable in the lengthwise direction of the carpet 301 along a drive track 334. Each of the blades in an array may be individually moveable, or all the blades in the array can move in locked sequence, e.g., sequentially, simultaneously. Each blade 330, 340 in the arrays of blades 330, 340 may also be moveable vertically, toward and away from the carpet 301 when the carpet 301 is supported on the pedestals 322. The blades 330, 340 can be any suitable blade, knife, or other edge suitable for cutting through the backing 302 of the carpet 301; in one particular example, the blades 330, 340 are rotary blades (e.g., 8 inch stainless steel or carbide rotary blades), each blade 330, 340 driven by a respective motor 335, 345 (e.g., ½ Hp motor).

Figure 5:
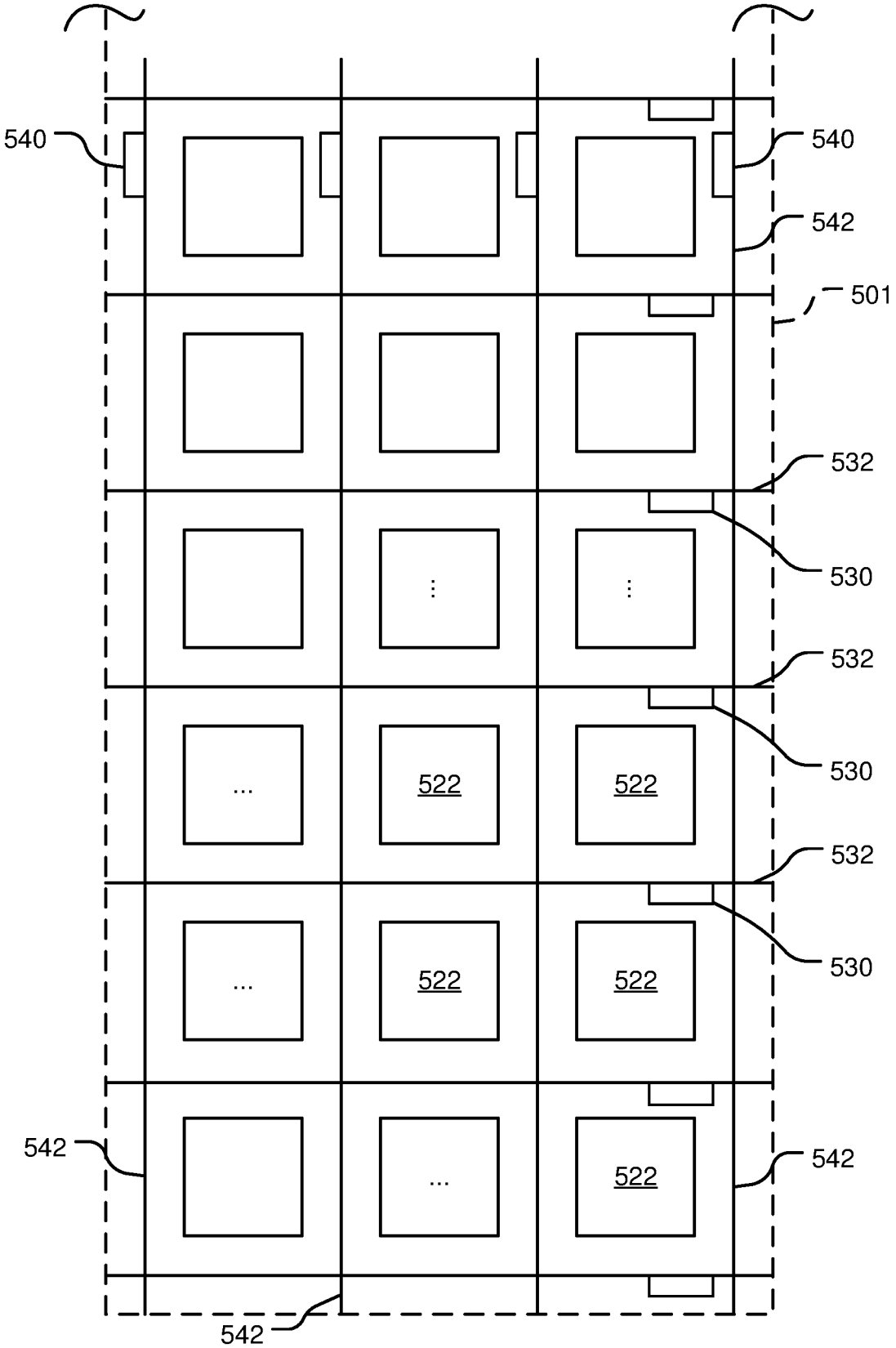
FIG. 5 is a top view of an example cutting station.

FIG. 5 shows one example of multiple pedestals 522, multiple crosscut blades 530, each on a cross track 532, and multiple lengthwise blades 540, each on a lengthwise track 542; this particular example has 18 pedestals 522, 7 crosscut blades 530 and 4 lengthwise blades 540, although it is understood that other numbers of blades could be used, e.g., 4 crosscut blades 530 and 7 lengthwise blades 540; 5 crosscut blades 530 and 5 lengthwise blades 540; 8 crosscut blades 530 and 6 lengthwise blades 540, etc. The number of pedestals 522, crosscut blades 530 and lengthwise blades 540 are selected based on the width of the incoming carpet (e.g., 6 ft, 12 ft, 18 ft, etc.) and the desired resulting tile size. The arrangement of FIG. 5 could be adjusted (e.g., the number of pedestals 522, crosscut blades 530, cross tracks 532, lengthwise blades 540 and lengthwise tracks 542) to be used with the system 300 of FIGS. 3 and 4 or any other system.

The blades 530, 540 are connected to motor(s) to operate the blades 530, 540 and to move the blades 530, 540 along their respective traces 532, 542. The cross tracks 532 extend crosswise between the pedestals 522 and lengthwise tracks 542 extend lengthwise between the pedestals 522. In the particular example of FIG. 5, a carpet 501 (in phantom) is shown in relationship to a 3 by 6 array of pedestals 522, with 3 pedestals arranged crosswise in relation to the carpet 501 and 6 pedestals 522 arranged lengthwise in relation to the carpet 501. This particular example, having 28 blades 530, 540, will form 18 carpet tiles having each of the four edges cut. Of course, other numbers of pedestals and blades can be used. In general, one more crosswise blade 530 is used than the number of carpet strips cut and one more lengthwise blade 540 is used than the number of tiles cut; this results in each of the four edges of the tile being cut.

Returning to FIGS. 3 and 4, understanding the general arrangement of the pedestals, crosscut and lengthwise blades, and their tracks, an example method of cutting carpet tiles from a carpet roll is as follows.

From the feed station 310, the carpet 301 is unrolled and fed into the carpet cutting station 320 via the feed mechanism 321, with the carpet face 303 and the carpet pile up, so that the carpet backing 302 is in contact with and supported on the pedestals 322. The carpet 301 is pushed across the support pedestals 322 by various rollers until all support pedestals 322 are covered. The retainer 324 is lowered over the surface 303 of the carpet 301, pressing down on the cut pile of the carpet 301, holding the carpet 301 securely to the pedestals 322.

Each of the blades 330 of the array of crosscut blades 330 passes between the support pedestals 322 along its respective cross track, resulting in strips of carpet being cut from the carpet roll. To cut the carpet, each of the blades 330 is set to a height to pass through (cut) the backing 302 of the carpet 301. In some implementations, depending on the length of the pile, little or no portion of the blade 330 extends past the backing 302 into the pile of the carpet; any amount of blade 330 that extends past the backing 302 does not cut any of the pile. Again, depending on the length of the pile, the blade 330 may extend no more than, e.g., about ⅛ inch or 1/16 inch or 1/32 inch past the backing 302 into the pile, and if it does, it does so without cutting the pile.

After the crosscut blades 330 have cut through the backing 302 of the carpet 301, the longitudinal array of blades 340 passes between the support pedestals 322 cutting the previously-cut strips into individual tiles. As before, to cut the carpet, each of the blades 340 is set to a height to pass through (cut) the backing 302. In some implementations, little or no portion of the blade 340 extends past the backing 302 into the pile of the carpet; any amount of blade 340 that extends past the backing 302 does not cut any of the pile. Again, depending on the length of the pile, the blade 340 may extend no more than, e.g., about ⅛ inch or 1/16 inch or 1/32 inch past the backing 302 into the pile, and if it does, it does so without cutting the pile.

The retainer 324 then releases the cut tiles from the pedestals 322, and in some implementations, lifts (e.g., via suction) the resulting tiles off the support pedestals 322. The tiles can be moved (e.g., to a conveyor belt) for further processing, such as application of adhesive to the back of the tiles.

By having the blades 330, 340 with an adjustable cutting depth, the blades 330, 340 can be adjusted so that the blades 330, 340 essentially cut only through the substrate 302 and leave the piles undisturbed, resulting in a virtually invisible seam when the tiles are abutted, such as in FIG. 2.

In an alternate implementation, the carpet 301 is unrolled and fed into the carpet cutting station 320 via the feed mechanism 321 with the backing 302 up so that the carpet face 303 and the carpet pile are in contact with and supported on the pedestals 322 or other support mechanism. In such a process, the blades 330, 340 are mounted above the carpet 301 (e.g., on a gantry). Also in such a process, because the blades 330, 340 pass through the backing 302 from the top to cut the backing 302 and not cut the pile. As before, each of the blades 330 of the array of crosscut blades 330 passes across the carpet backing 302, resulting in strips of carpet being cut from the carpet roll, and then the longitudinal array of blades 340 cut the previously-cut strips into individual tiles. Again, each of the blades 330, 340, even when mounted above, is set to a height to pass through (cut) the backing 302 of the carpet 301, without cutting the pile of the carpet.

Figure 6:
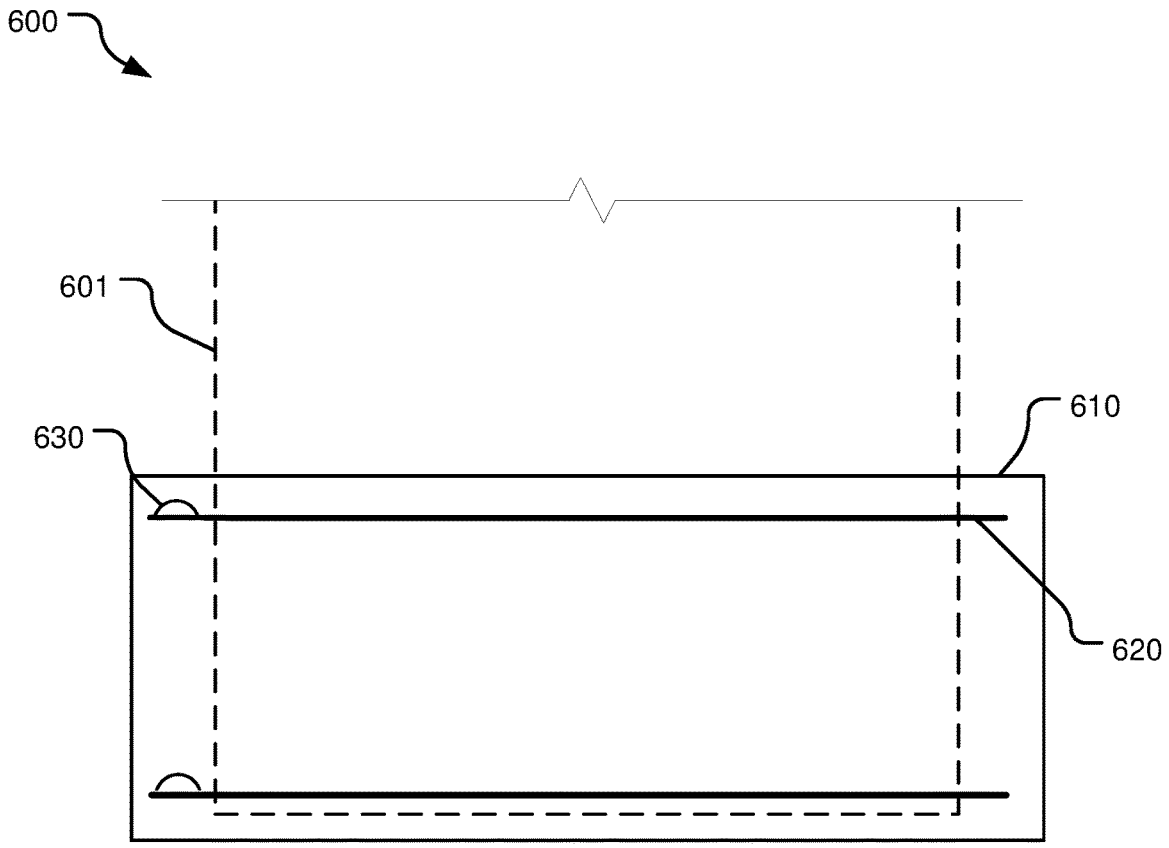
FIG. 6 is a top view of an example strip cutting station.
Figure 7:
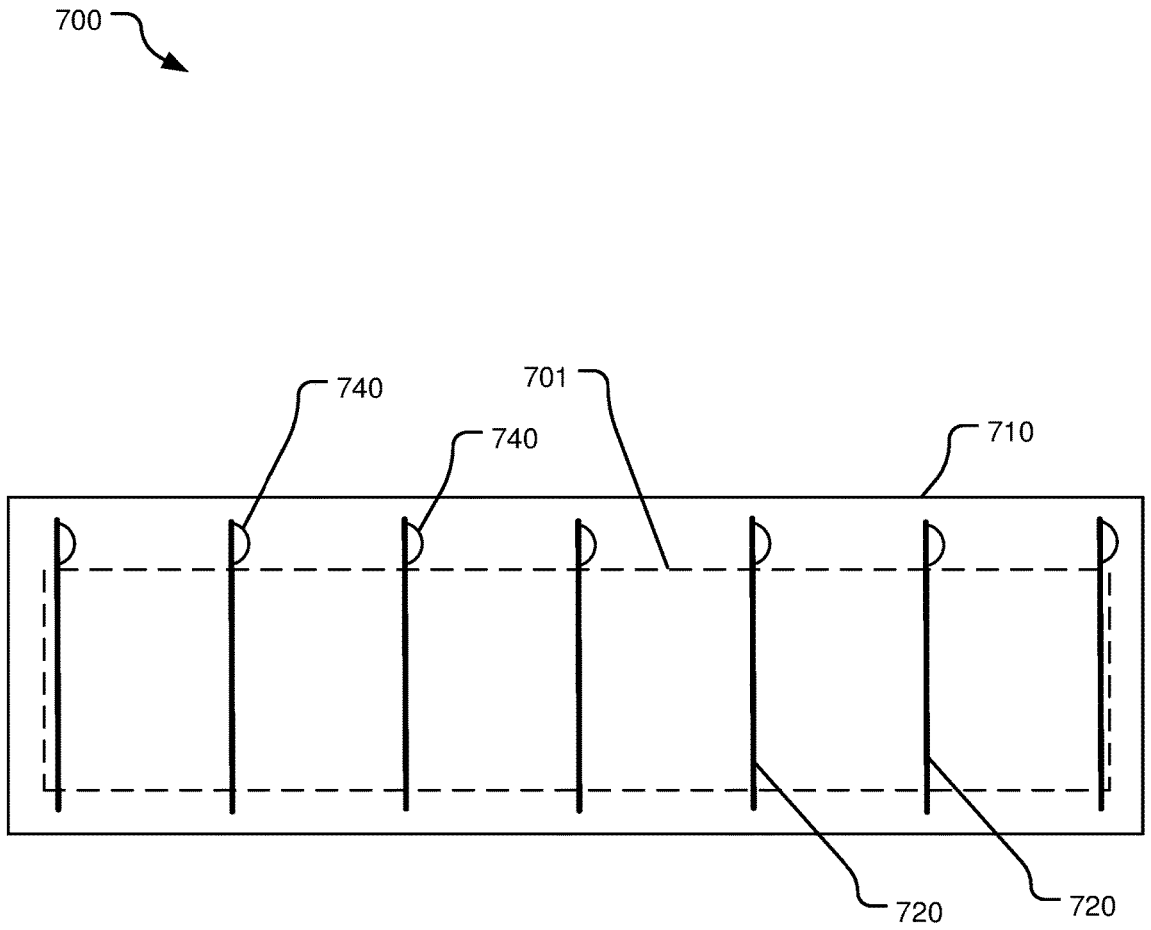
FIG. 7 is a top view of an example tile cutting station.

FIGS. 6 and 7 illustrate schematically another example carpet cutting station; particularly, FIG. 6 illustrates a strip cutting station 600 and FIG. 7 illustrates a tile cutting station 700.

In FIG. 6, the strip cutting station 600, for cutting a strip from an elongate carpet 601 (in phantom), is shown having a cutting table 610, the table 610 having a surface with grooves or slots 620 extending through the table 610. The table 610 may have any width (crosswidth of the carpet) and any length, as desired to handle carpets of various width (e.g., 6 ft, 12 ft, 18 ft, etc.). The carpet 601 is shown on the table 610 in phantom, with the backing of the carpet 601 against the surface of the table 610 and extending across the grooves 620.

Positioned below the table 610 are at least moveable two blades 630, aligned with the grooves 620 so that each blade 630 extends through the table 610 the length of the groove 620. Any number of blades 630 may be present on the strip cutting station 600, depending on the number of strips of carpet to be cut; in general, there will be one more blade 630 than desired strip. The blades 630 are supported by a track (not seen in FIG. 6) extending under the table 610 proximate to the grooves 620. Suitable mechanisms (e.g., motors) are provided to move each blade 630 along its track and to operate the blade 630, if needed.

To cut a strip from the carpet 601, the carpet 601 is moved onto the table 610 and held or otherwise secured to the table 610. The blades 630 rise up through the table 610, cutting into the backing of the carpet sufficient to cut the backing and not the pile. The blades 630 are moved along the grooves 620, either simultaneously or sequentially, to cut the strip.

From the strip cutting station 600, the carpet strip moves (via e.g., conveyor belt(s), vacuum pick-up, manually) to the tile cutting station 700 shown in FIG. 7. The tile cutting station 700 has a cutting table 710 having a surface with grooves or slots 720 extending through the table 710 but not across the entire width of the table 710. The table 710 may have any width and any length, as desired to handle carpet strips of various width and length. A carpet strip 706 (in phantom) is shown on the table 710, with the backing of the strip 706 against the surface of the table 710 and extending across the grooves 720.

Positioned below the table 710 are multiple moveable blades 740, aligned with the grooves 720 so that each blade 740 extends through the table 710 the length of the groove 720. Any number of blades 740 may be present on the tile cutting station 700, depending on the number of tile to be cut from the strip; in general, there will be one more blade 740 than desired tiles. In the particular example of FIG. 7, seven blades 740 are present to cut 6 tiles. The blades 740 are supported by tracks (not seen in FIG. 7) extending under the table 710 proximate to the grooves 720. Suitable mechanisms (e.g., motors) are provided to move each blade 740 along its track and to operate the blade 740, if needed.

To cut the strip 706 into individual tiles, the strip 706 is moved onto the table 710 and held or otherwise secured to the table 710. The blades 740 rise up through the table 710, cutting into the backing of the strip sufficiently far to cut the backing and not the pile. The blades 740 are moved along the grooves 720, either simultaneously or sequentially, to cut the strip into individual tiles.

Figure 8:
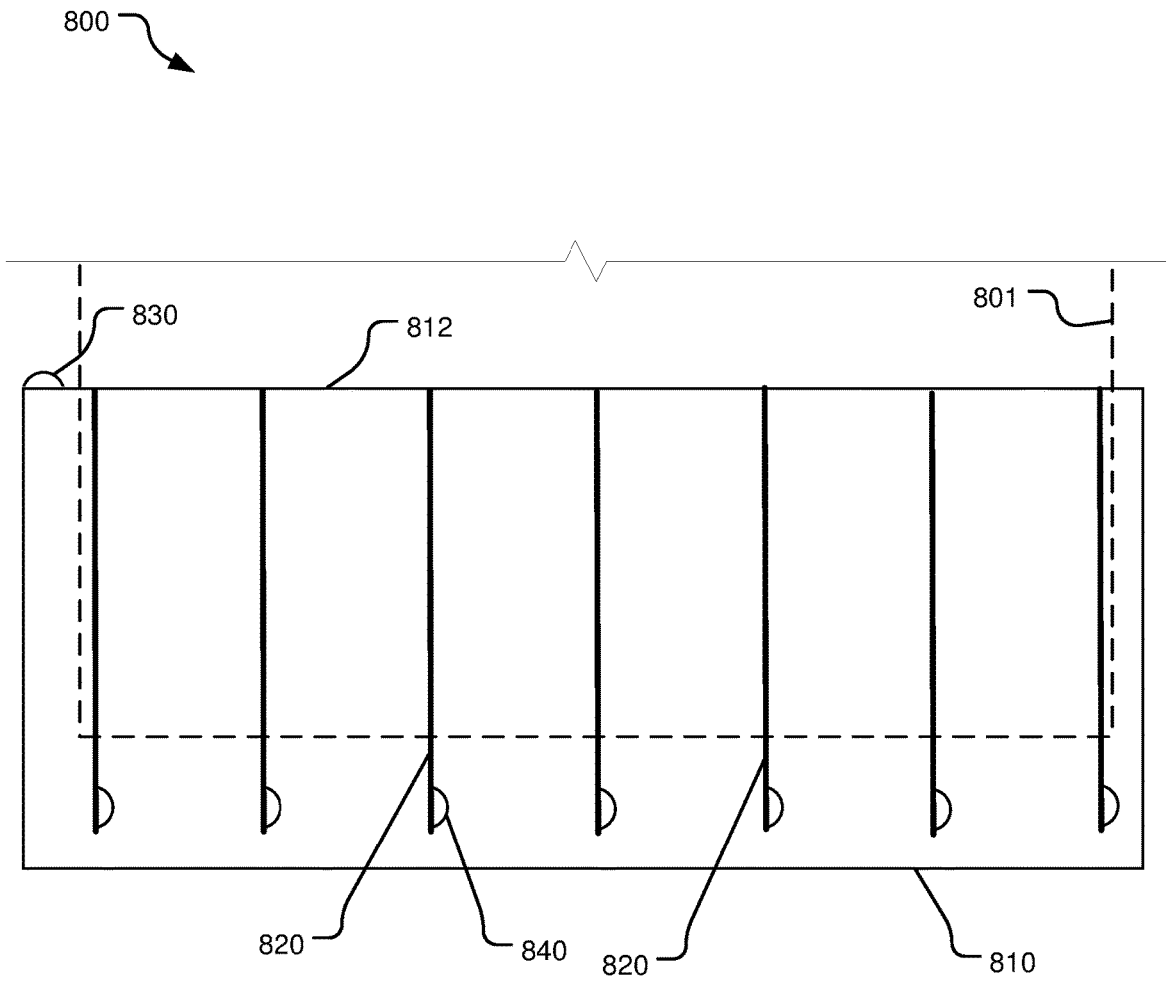
FIG. 8 is a top view of another example cutting station.

FIG. 8 illustrates another example carpet cutting station 800 for cutting tiles from elongated or large pieces of carpet.

The cutting station 800 is a single location apparatus having a table 810 with multiple grooves or slots 820 extending through the table 810 in from an edge 812 of the table 810. A length of carpet 801 (in phantom) is shown on the table 810, and extending off of the table 810, with the backing of carpet 801 against the surface of the table 810.

Positioned adjacent to the table edge 812 is a single blade 830 moveable along the edge 812. Suitable mechanisms (e.g., motors) are provided to move the blade 830 along the edge 812 and to operate the blade 830, if needed. Positioned below the table 810 are multiple moveable blades 840, aligned with the grooves 820 so that each blade 840 extends through the table 810 the length of the groove 820. Any number of blades 840 may be present on the cutting station 800, depending on the number of tile to be cut from the carpet 801; in general, there will be one more blade 840 than desired tiles. In the particular example of FIG. 8, seven blades 840 are present to cut 6 tiles. The blades 840 are supported by tracks (not seen in FIG. 8) extending under the table 810 proximate to the grooves 820. Suitable mechanisms (e.g., motors) are provided to move each blade 840 along its track and to operate the blade 840, if needed. The blades 830, 840 cut into the backing of the carpet 801 sufficiently far to cut the backing and not the pile.

With this exemplary station 800, the carpet 801 is fed onto the table 810 perpendicular to the cross cut blade 830 and is stopped at a position such that when the blade 830 passes through the backing of the carpet 801, a carpet strip of the desired width is produced. The blades 840 then cut the resulting strip into tiles. After the tiles are conveyed away, the process can repeat with the cut edge being fed out the desired width for the next carpet strip.

In alternate implementations of the stations 600, 700, 800, the carpet is provided with the backing up so that the carpet face and the carpet pile are in contact with and supported on the table or other support mechanism. In such a process, the blades 630, 740, 830, 840 are mounted above the carpet (e.g., on a gantry). The grooves 620, 720, 820 through the table 610, 710, 810 could be removed or replaced with channels that do not extend all the way through the table. As before, each of the blades 630, 740, 830, 840 pass through (cut) the backing of the carpet without cutting the pile of the carpet.

Figure 9:
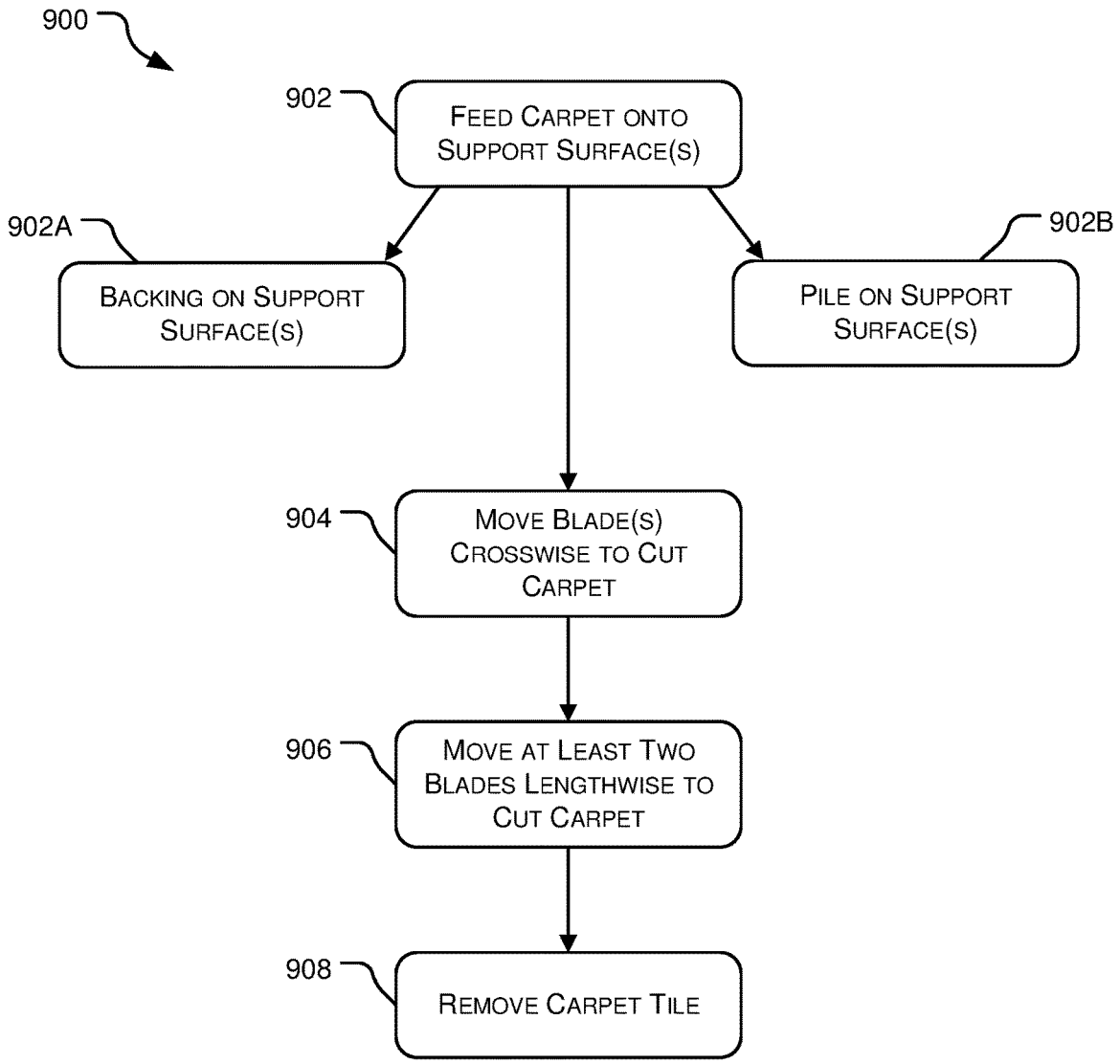
FIG. 9 is a flowchart depicting an example method.

FIG. 9 provides, stepwise, an example method 900 for cutting carpet tiles. In operation 902, an extended length of carpet is fed onto pedestals, a table or other support surface (s). The backing may be supported with its backing on the support surface(s), as per operation 902A, or the pile (carpet face) may be supported on the support surface(s), as per operation 902B. In operation 904, at least one blade is moved crosswise across the carpet backing, cutting the carpet to form at least one strip; the blades extend through the carpet backing and do not cut the pile. In operation 906, at least two blades are moved lengthwise across the carpet backing, cutting the previously-cut strip to form at least one tile; the blades extend through the carpet backing and do not cut the pile. If the backing is on the support surface (as per operation 902A), the blades cut upward into the backing. If the pile is on the support surface (as per operation 902B), the blades cut downward into the backing. In operation 908, at least one carpet tile, having four cut edges, is removed.

Advantages associated with the methods described herein include, without limitation, the ability to cut carpet (e.g., broadloom carpet) into carpet tiles with undisturbed edge piles, so that when tiles are abutted, the result is a seamless appearance. Furthermore, a process utilizing a blade array and supporting pedestal approach, it is possible to cut multiple tiles in a single pass of each blade array. This approach leads to operational efficiencies and allows for a higher throughput capacity of the cutting apparatus.

The above specification provides a description of the structure and use of exemplary implementations of the invention. The above description provides specific implementations. It is to be understood that other implementations are contemplated and may be made without departing from the scope or spirit of the present disclosure. The above detailed description, therefore, is not to be taken in a limiting sense. While the present disclosure is not so limited, an appreciation of various aspects of the disclosure will be gained through a discussion of the examples provided.

Unless otherwise indicated, all numbers expressing feature sizes, amounts, and physical properties are to be understood as being modified by the term "about." Accordingly, unless indicated to the contrary, any numerical parameters set forth are approximations that can vary depending upon the desired properties sought to be obtained by those skilled in the art utilizing the teachings disclosed herein.

As used herein, the singular forms "a", "an", and "the" encompass implementations having plural referents, unless the content clearly dictates otherwise. As used in this specification and the appended claims, the term "or" is generally employed in its sense including "and/or" unless the content clearly dictates otherwise.

Spatially related terms, including but not limited to, "bottom," "lower", "top", "upper", "beneath", "below", "above", "on top", "on," etc., if used herein, are utilized for ease of description to describe spatial relationships of an element(s) to another. Such spatially related terms encompass different orientations of the device in addition to the particular orientations depicted in the figures and described herein. For example, if a structure depicted in the figures is turned over or flipped over, portions previously described as below or beneath other elements would then be above or over those other elements.

Since many implementations of the invention can be made without departing from the spirit and scope of the invention, the invention resides in the claims hereinafter appended. Furthermore, structural features of the different implementations may be combined in yet another implementation without departing from the recited claims.

What is claimed is:

1. A method for forming carpet tiles, comprising:

providing a roll of carpet on a carpet roll support in a carpet feed station, wherein the carpet comprises a width, a length, and a backing with pile extending from the backing;

feeding the carpet from the carpet feed station to a carpet cutting station, wherein the carpet cutting station comprises a roll feed mechanism configured to receive the carpet, a plurality of pedestals arranged as an array extending crosswise and lengthwise in relation to the carpet, a vacuum press movably disposed above the plurality of pedestals, a plurality of crosscut blades, a plurality of lengthwise blades, a plurality of cross tracks, and a plurality of lengthwise tracks, wherein each crosscut blade of the plurality of crosscut blades is movable along and supported by a cross track of the plurality of cross tracks disposed between the plurality of pedestals, wherein each lengthwise blade of the plurality of lengthwise plurality of blades is movable along and supported by a lengthwise track of the plurality of lengthwise tracks disposed between the plurality of pedestals, wherein the carpet is fed into the carpet cutting station via the feed mechanism, and wherein the backing is in contact with and supported by the plurality of pedestals;

lowering the vacuum press over the pile of the carpet to hold the carpet on the plurality of pedestals;

cutting the backing of the carpet with the plurality of crosscut blades to form a plurality of carpet strips, wherein each crosscut blade of the plurality of crosscut blades moves under the carpet along the cross track supporting the crosscut blade as the crosscut blade cuts the backing of the carpet, and wherein the pile extending from the backing of the carpet is uncut by the plurality of crosscut blades;

cutting the plurality of carpet strips with the plurality of lengthwise blades to form a plurality of carpet tiles, wherein each carpet tile of the plurality of carpet tiles comprises pile, wherein each lengthwise blade of the plurality of lengthwise blades moves under the plurality of carpet strips along the lengthwise track supporting the lengthwise blade as the lengthwise blade cuts the plurality of carpet strips, and wherein the pile of each carpet tile of the plurality of carpet tiles is uncut by the plurality of lengthwise blades; and, lifting the plurality of carpet tiles from the plurality of pedestals, wherein lifting the plurality of carpet tiles comprises applying suction from the vacuum press to the plurality of carpet tiles.

2. The method of claim 1, wherein the plurality of crosscut blades and the plurality of lengthwise blades are movable vertically.

* * * * *